US005119346A

United States Patent [19]

Henderson et al.

[11] Patent Number: 5,119,346

[45] Date of Patent: Jun. 2, 1992

[54] CHILD ALARM SYSTEM

[75] Inventors: Deborah J. Henderson, 1421 N.W. 74th St., Kansas City, Mo.; Donald L. Rohrs, Overland Park, Kans.

[73] Assignee: Deborah J. Henderson, Kansas City, Mo.

[21] Appl. No.: 465,394

[22] Filed: Jan. 16, 1990

[51] Int. Cl.[5] ..... G04F 8/00; G04C 9/00; G04C 21/00

[52] U.S. Cl. ..... 368/109; 368/187; 368/250

[58] Field of Search ..... 368/12, 69, 70, 107-109, 368/185, 187, 188, 250, 251, 282

[56] References Cited

U.S. PATENT DOCUMENTS 3,293,846 12/1966 Pauli ..... 368/282
3,786,628 1/1974 Fossard et al. ..... 368/250
3,822,547 7/1974 Fujita ..... 368/251
4,058,971 11/1977 Epperson ..... 368/70
4,103,483 8/1978 Riley ..... 368/187
4,178,751 12/1979 Liautaud ..... 368/282
4,681,461 7/1987 Gogniat ..... 368/187
4,785,433 11/1988 Bush et al. ..... 368/109

*Primary Examiner*—Vit W. Miska
*Attorney, Agent, or Firm*—Litman, McMahon & Brown

[57] ABSTRACT

A portable timing and alarm apparatus for alerting a child that a pre-set interval of time for playing or for observing a pre-arranged response has expired. An audible alarm signals the wearer of the apparatus that the time interval has expired. The length of the time interval is adjustable by use of a key to prevent tampering by the child. In one embodiment, the key is engaged by inserting the apparatus into a module which simultaneously allows two spaced enabling pins to engage mating switches on the apparatus that, when triggered, allow time setting adjustment thereof.

13 Claims, 2 Drawing Sheets

Fig. 1.
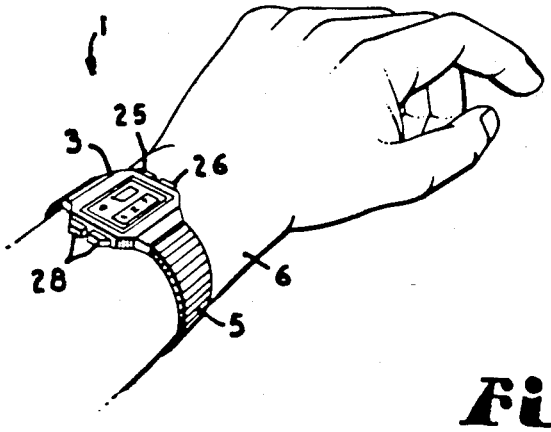
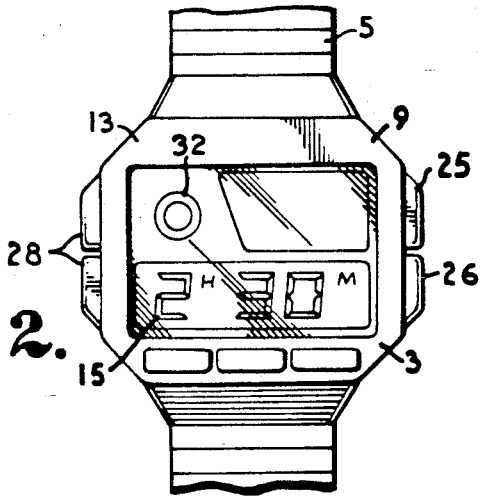
Fig. 2.
Fig. 3.
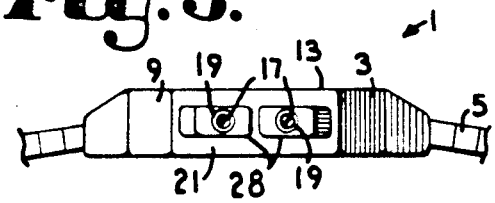
Fig. 4.
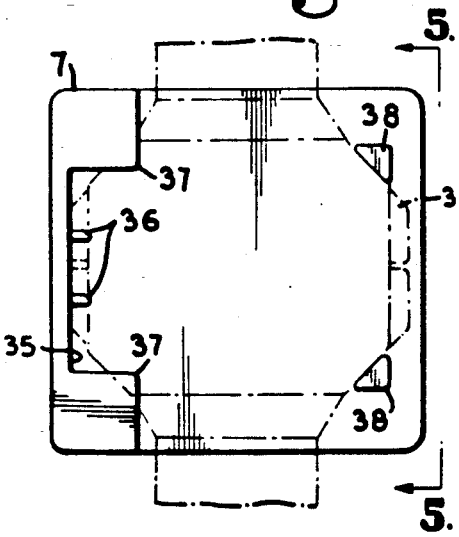
Fig. 11.
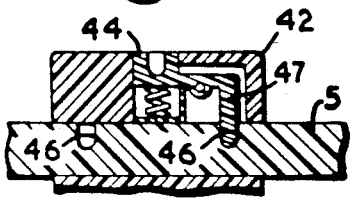
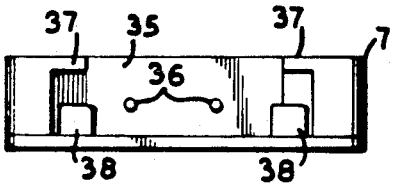
Fig. 5.

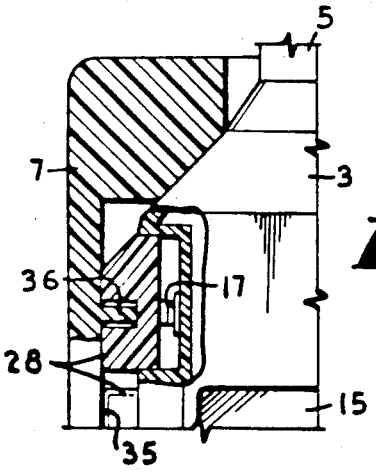
Fig.6.
Fig.7.
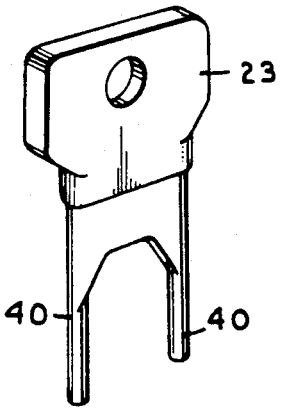
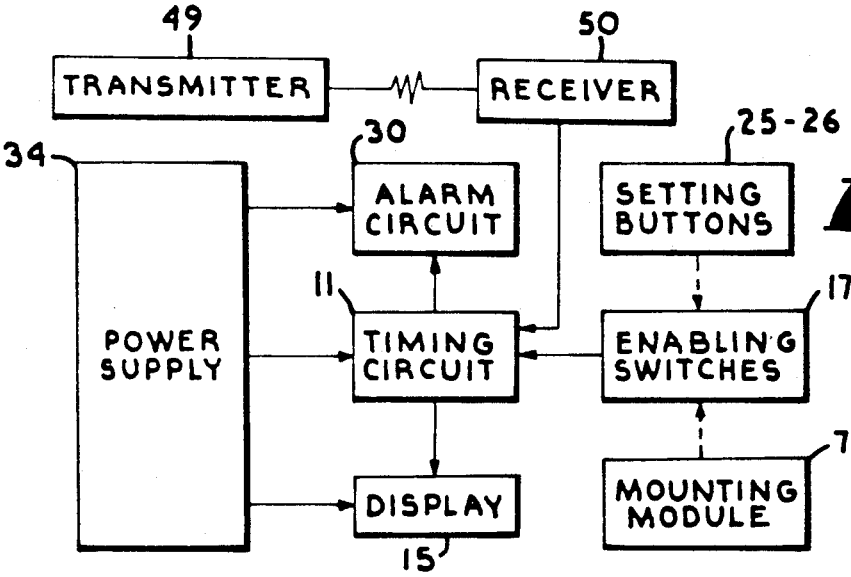
Fig.8.
Fig.9.
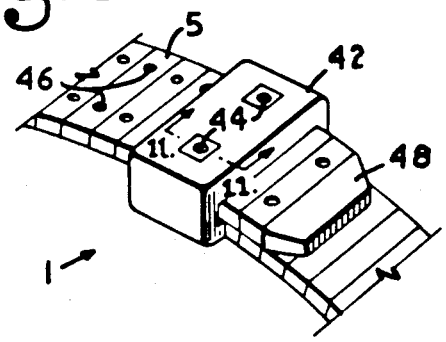
Fig.10.
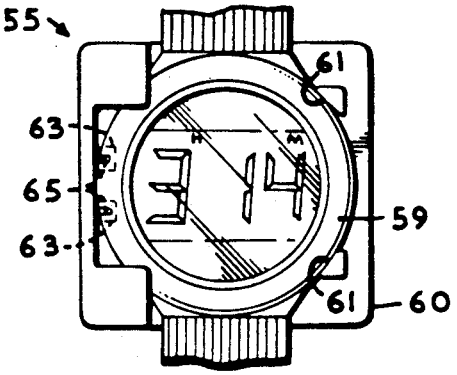

CHILD ALARM SYSTEM

BACKGROUND OF THE INVENTION

The present application relates to a child alarm apparatus comprising a timing mechanism for counting down an amount of time remaining in a pre-determined time interval before a pre-arranged response from a child is required. In particular, the apparatus includes a display to visually inform the child as to the amount of the time remaining and an alarm to alert the child when the time interval has expired.

Children often go outside their house to play, often in association with other children which frequently means the child will leave their own yard to play in a more communal area or at the house of a friend. During many of those times it is impractical or impossible for a parent or an adult to provide constant and continuous supervision. For example, a child may play outside while their parents are preparing a meal.

Due to the wanderings of a young mind and due to a lack of a more fully developed appreciation of certain responsibilities to and concerns of others, the expiration of the amount of time allotted for playing before reporting back to a particular parent or adult may pass unnoticed. Sometimes the child may even deliberately ignore such a reporting time because the child is enjoying playing or the like, later using the excuse that they did not realize what time it was. If the whereabouts of the child are not precisely known by the responsible parent or adult, anxiety may be generated which may subsequently be passed on to the child in a disciplinary form which the child may feel was unwarranted and/or the child may miss important events such as meal time.

Thus, a decided need exists for an apparatus which will provide a child with the ability to determine the amount of allotted playtime remaining and that the time has expired in such a manner that the child cannot ignore and which will, therefore, help the child develop a sense of responsibility to a supervising parent or adult. In so doing, anxieties of the parent or adult, which arise from untimely responsiveness of the child during unsupervised play intervals, will be minimized or eliminated.

It is also desirable to have such a device that cannot be readily tampered with by children trying to develop an alibi for not reporting when the alarm should sound and that is not easily removed by the child so they cannot make the excuse that the apparatus was misplaced or lost.

SUMMARY OF THE INVENTION

A timing and alarm apparatus includes a timer for alerting a child as to the amount of time remaining in an interval of time allotted for unsupervised recreation by self or with other children and an alarm for notifying the wearer of the expiration of the period. The timing apparatus is portable such that it can be secured about the body or to wearing apparel of the child in the form of a wristwatch or the like. A replaceable battery or solar cell provides the power for the timer and for the alarm.

The time interval is originally set by activating a timer reset switch with a suitable key. In one embodiment, the timer is reset by inserting the timer into a module which simultaneously and concurrently depresses two reset switches to enable an adult to operate a pair of setting buttons, one of which sets the number of hours and the other sets the number of minutes in the allotted playtime interval. Upon removal of the timer from the module, the timer begins to count down the time set on the timer and cannot easily be tampered with by a child without an appropriate key. The number of hours and minutes remaining in the time interval is displayed on a liquid crystal display device on the face of the timer. When the remaining number of hours and minutes has diminished to zero, an audio alarm sounds alerting the child that the designated time interval has expired.

In certain embodiments of the apparatus, the wristband will also effectively lock thereby requiring a key held by the adult to unlock the wristband so the child cannot accidentally or deliberately misplace the apparatus.

OBJECTS OF THE INVENTION

Therefore, the objects of the present invention are: to provide an apparatus to alert a child that a predetermined interval of time has expired; to provide an apparatus which is portable and securable about the body of a child; to provide an apparatus which is resistant to removal from a child's body by the child; to provide an apparatus with a time interval setting mechanism which is resistant to alteration thereof by the child; to provide a mechanism which is resistant to physical damage during rigorous activity by the child; to provide an apparatus with a display to inform the chil as to the amount of time remaining in an allotted time interval; to provide an apparatus adaptable to a variety of appearances to appeal to each of the genders and different age groups; to provide an apparatus with a reasonably loud, audible alarm or other attribute to alert and elicit a response from the child; and to provide an apparatus which is relatively inexpensive to produce, easy to maintain, simple to operate and which reliably performs its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a child alarm apparatus in accordance with the present invention shown being worn by a user.

FIG. 2 is an enlarged and fragmentary top plan view of the apparatus.

FIG. 3 is an enlarged and fragmentary side elevational view of the apparatus.

FIG. 4 is a top plan view of a reset module for use in connection with the apparatus, showing (in phantom) the apparatus inserted therein.

FIG. 5 is a side elevational view of the module taken along line 5—5 of FIG. 4.

FIG. 6 is an enlarged and fragmentary top plan view of the apparatus inserted into the module with portions broken away to show detail thereof.

FIG. 7 is an enlarged perspective view of an enabling key for use in resetting the apparatus.

FIG. 8 is a schematic block diagram illustrating the electrical components of the apparatus.

FIG. 9 is an enlarged perspective view of a latch on a wristband of the apparatus.

FIG. 10 is an enlarged and fragmentary top plan view of a modified child alarm apparatus inserted into the module according to the present invention.

FIG. 11 is an enlarged and fragmentary cross-sectional view of a latching mechanism taken along line 11—11 of FIG. 9.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a play timer or child alarm apparatus in accordance with the present invention. The apparatus comprises a portable timer and alarm device 3 with child attachment means such as the illustrated loop, strap, or band 5 about a child's wrist 6, as shown in FIG. 1, and a generally child tamperproof reset means that is illustrated as a keeper or module 7, as shown in FIG. 4. It is foreseen that attachment means other than securement about a wrist are equally applicable, such as suspension from the neck by a lanyard, cord or chain (not shown) or the like.

The timer and alarm device 3 includes a body 9 which is molded or otherwise formed of a durable material, which is inexpensive to manufacture and readily attainable, such as high impact, break-resistant plastic. In addition, the body 9 has a relatively low profile, such as that illustrated in FIG. 3, in order to survive rigorous activity by the child.

Contained within the body 9 is a timing circuit 11, including readily available electronic circuitry having integrated circuit devices, for measuring a pre-determined interval of time. For example, the present embodiment of the invention is adapted to measure time intervals in the range of from one minute to about ten hours.

The body 9 has an outer face 13 incorporating a readout mechanism or display means, such as the illustrated digital liquid crystal ("LCD") monitor or display 15. The display 15 is adapted to show either visually, digitally or otherwise, the amount of time remaining in the predetermined interval of time selected by an adult as described below. In the example shown, the display 15 exhibits three digits, with one digit for the number of remaining hours in the predetermined interval of time and two digits for the number of remaining minutes.

Enabling means, such as the illustrated pair of enabling switches 17 having access on the side of the apparatus 1, as is shown in FIG. 3, allow a generally child tamper-resistant mechanism for setting or re-setting the time interval. As a precautionary measure to prevent the child from accidentally or arbitrarily modifying the amount of time remaining, the reset enabling switches 17 of the illustrated embodiment must be simultaneously depressed while the time interval is altered. The switches 17 are recessed within the timer body 9 and can be accessed only through two spaced, parallel and relatively narrow slots or bores 19 in a side 21 of the timer body 9 and are configured such that the switches 17 cannot easily be depressed without the aid of key means, such as is contained in the module 5 (see FIG. 4) or a key 23 (see FIG. 7), as hereinafter described. The purpose of the enabling switches 17 is to make it relatively difficult for a child to determine how the enabling mechanism operates and further to make it difficult for the child to construct a tool to simultaneously trigger the enabling switches 17 if such a child does learn how the enabling mechanism works. It is foreseen that other equivalent enabling means could be utilized in accordance with the invention.

When the switches 17 are depressed, setting buttons 25 and 26 located opposite the switches 17 on the body 9 allow an adult to independently adjust the number of hours and the number of minutes, respectively, to be measured by the timing circuit 11. Specifically, depressing the button 25 increases the number of hours and depressing the button 26 increases the number of minutes registered on the display 15 respectively. The timing circuit 11 resets the time period to zero each time the enablng switches 17 are triggered. Therefore, an adult can restart the setting procedure by withdrawing the key means and then reinserting it into the switches 17 if too much time is inadvertently placed on the timer or it is necessary to change the time during use. In the illustrated embodiment of FIG. 2, the side 21 is shaped in the form of two dummy buttons 28 with the switches 17 hidden therein to match buttons 25 and 26 for cosmetic purposes and to further confuse a child who is trying to tamper with the apparatus 1.

Also, contained within the body 9 is an alarm circuit 30 including an audio alarm which is operatively activated by the timing circuit 11 when the selected time on the display 15 expires. For children without hearing problems, the alarm circuit 30 is a small speaker or solid state sounding device 32 which is driven by an audio signal generator incorporated in the alarm circuit 30, such that a loud audible signal is radiated. Alternatively, for children who are deaf or suffering from hearing impairment problems, it is foreseen that an alerting mechanism such as an electric vibrator or unbalanced oscillatory mechanical device or the like, may be used with the alarm circuit to generate a mechanical vibratory signal which can be physically sensed by the child. Such a child, who may be capable of comprehending the information provided by the display 15, can verify and confirm the vibratory signal by examining the display 15.

Also contained with the body 9 is a power supply 34 comprising a replaceable battery to supply the necessary energy to drive the timing circuit 11, the display 15, and the alarm circuit 30.

The module 7 is adapted such that the body 9 of the timer 3 is slidably insertable into a receiver 35 therein, shown in FIG. 6 and in phantom in FIG. 4, a pair of pins 36 are adapted to mesh with and fully depress the reset enabling switches 17. A pair of tabs 37 positioned in opposite corners of the receiver 35 assure alignment of the bores 19 with the pins 36 as the timer 3 is inserted into the module 7. A pair of locator pads 38 opposite the tabs 37 in the receiver 35 frictionally snugly hold the apparatus 1 within the module 7 and bias the pins 36 against the switches 17 so as to activate same. The buttons 25 and 26 are accessible to an adult when the apparatus 1 is in the module 7, to allow the adult to then select and set a time on the display 15 by manipulation of the buttons 25 and 26. After the time interval has been set with the buttons 25 and 26, the timing mechanism 11 will not- begin its countdown until the timer 3 is removed from the module 7 and the switches 17 become deactivated.

Alternatively, it is foreseen that the module 7 can serve a further purpose of providing a means (not shown) to recharge a battery contained in the timer body 9 while the timer 3 remains inserted into the module 7. In that event, the module 7 is provided with an external source of power for recharging purposes and has a connection interfacing with the exterior of the timer body 9 for distributing the recharging electrical energy to the rechargeable battery therein. Also alternatively or additionally, it is foreseen that the timer 3 may be equipped with a photovoltaic cell such that solar energy may be utilized to drive the timing mechanism 11, the display 15, and the alarm circuit 30.

When the module 7 is not available, alternatively the key 23 may be used to reset the time interval. The key 23 includes a pair of prongs 40 that are spaced to simultaneously depress the switches 17 when the prongs 40 are inserted into the bores 19 of the apparatus 1, such that the time interval can be similarly set as aforesaid with the module 7.

In actual operation, the timer 3 is normally inserted into the module 7. When inserted therein, the pins 36 penetrate the bores 19 and depress the switches 17, thereby triggering or activating the switches 17 and the timing circuit 11. With the timer 3 remaining inserted in the module 7, the buttons 25 and 26 are manipulated to set the desired number of hours and minutes which must elapse after removal of the timer 3 from the module 7 before the alarm circuit 30 will be activated and an alarm sounded thereby.

After the timing circuit 11 has been set to the desired time interval, the timer 3 is removed from the module 7 whereupon the timing mechanism 11 immediately begins counting down the time remaining as simultaneously visibly displayed by the readout display 15 as a reducing quantity.

The timer 3 is then secured to the child's body. In the illustrated embodiment of the apparatus 1, the band 5 includes latching means such as a latch 42 as shown in FIG. 9, to provide securement thereof. A pair of mechanical releases 44 coordinated with indents 46 in the band 5 are spaced to communicate with the prongs 40 of the key 23. Insertion of the prongs 40 into the releases 44 allows locking pins in the latch 42, such as the spring-loaded, pivotally mounted pins 47 shown in FIG. 11, to be withdrawn from meshing with the indents 46 such that a male end 48 of the band 5 can be removed from the latch 42, thus releasing the timer 3 from securement to the child's body. An added incentive to promote a spirit of cooperativeness by the child is the instilling of a pride of ownership on the child's part since the apparatus 1 is designed to appear as a watch and to be part of the child's wearing apparel.

It is foreseen that, when a lanyard or the like is used for securement purposes, loops may be used in conjunction with a small lock to prevent unauthorized removal of the timer 3 from the child's body.

After sufficient time has transpired to deplete the pre-set time interval, the alarm circuit 30 is activated by the timing circuit 11 signaling the child that the prearranged response is due. The alarm of the present embodiment sounds for a preselected time (for example, five seconds) and then stops. A transmitter 49 may be used to wirelessly communicate with a receiver 50 contained in the timer 3. By activating the transmitter 49, the alarm circuit 30 can be remotely controlled to prematurely signal the child that the time for the prearranged response has been accelerated.

A modified child alarm apparatus in accordance with the present invention is shown in FIG. 10 and is generally designated by the reference number 55. Many of the characteristics of the modified alarm system apparatus 55 are substantially similar to those already described for the apparatus 1 and will not be reiterated here in detail.

The modified alarm apparatus 55 has a circular body 59 to provide greater appeal to girls. For example, in the illustrated embodiment of FIG. 10, the body 59 is approximately ¼ inch thick with a diameter of approximately one inch. The physical shape of the body 59 is dimensioned and adapted to be snugly received in a setting module 60 by locator pads 61 and has openings 63 for receiving reset enabling pins 65 of the module 60. Hour and minute reset buttons are camouflaged opposite the openings 63, but are accessible while the timer 55 is inserted into the module 60.

It is to be understood that the present invention is not to be confined to the particular shapes disclosed herein, but is equally applicable to a multiplicity of shapes which may be gender oriented.

To minimize production expense, it is intended that modern equipment and methods be utilized using materials which are readily available through normal supply channels so that the present invention can be economically produced by any manufacturer engaged in production of electronic timing devices.

It is also to be understood that while certain forms of the present invention have been illustrated and described herein, it is not to be limited to the specific forms or arrangement of parts described and shown.

What is claimed and desired to be secured by Letters Patent is as follows:

1. A timer apparatus for alterting children to the passage of a selected interval of time, said apparatus comprising:

(a) timing means for tracking the selected interval of time operatively allowing a child wearing said apparatus to determine when the interval of time has elapsed;

(b) child-resistant reset means cooperating with said timing means to allow a user to set the interval of time in said timing means; said reset means comprise a pair of spaced switches; said switches requiring simultaneous triggering by a user thereof while the interval of time for the timing means is being set;

(c) alarm means for signaling the child at the expiration of the interval of time;

(d) a module for receiving said apparatus when not in use and for facilitating the resetting of said timer apparatus; and (e) key means for being adapted to be used to simultaneously trigger said switches; said key means comprise a pair of prongs mounted on said module.

2. A timer apparatus for alerting children to the passage of a selected interval of time, said apparatus comprising:

(a) timing means for tracking the selected interval of time operatively allowing a child wearing said apparatus to determine when the interval of time has elapsed;

(b) child-resistant reset means cooperating with said timing means to allow a user to set the interval of time in said timing means;

(c) alarm means for signaling the child at the expiration of the interval of time;

(d) fastening means securing said timing means to a child; and (e) generally child-resistant latching means for preventing the child from readily removing said timing means fro the child once said fastening means is secured; said latching means being operated by key means utilized to reset the interval of time.

3. The timer apparatus according to claim 2 wherein:

(a) said reset means comprise a pair of spaced switches; said switches requiring simultaneous triggering by a user thereof while the interval of time for the timing means is being set.

4. The timer apparatus according to claim 3 including:

(a) key means for being adapted to be used to simultaneously trigger said switches.

5. The timer apparatus according to claim 4 wherein:

(a) said switches are triggered by depression and positioned within parallel bores within said timer apparatus; and (b) said key means comprises a key having a pair of spaced parallel prongs sized and spaced to simultaneously be received in said bores and trigger said switches.

6. In combination with the timer apparatus according to claim 4:

(a) a module for receiving said apparatus when not in use and for facilitating the resetting of said timer apparatus; and (b) said key means comprise a pair of prongs mounted on said module.

7. The timer apparatus according to claim 17 wherein:

(a) said alarm means is an audio signal generator.

8. The timer apparatus according to claim 7 including:

(a) a transmitter remote from said timing means during use;

(b) a receiver associated to said timer apparatus and operably connected to said alarm means; whereby upon use of said transmitter, the receiver activates said alarm means.

9. A child alarm apparatus comprising:

(a) a timer portion and a module portion;

(b) said timer portion including an outer enclosure and fastening means to secure said apparatus to a child;

(c) electronic timing circuitry contained in said timer portion for measuring a plurality of selectable intervals of time;

(d) an audible alarm contained in said timer portion and interconnected to said circuitry to be triggered at the expiration of the selected time interval so as to alert the child to the expiration; said alarm being driven by an audio signal generator;

(e) power means to provide power for said timing circuitry and said alarm;

(f) a time reset control associated with said timer portion for setting said time interval;

(g) a display for displaying time remaining in the selected time interval;

(h) a pair of enable switches cooperating with said time reset control and requiring concurrent activation to set said time interval; and (i) a module portion adapted to receive said timer portion therein; said module portion having a pair of pins adapted to concurrently activate said pair of enable switches when said timer portion is positioned therein; said timer portion adapted to initiate the running of the time interval upon removal of said timer portion from said module portion.

10. The alarm apparatus according to claim 9 including:

(a) transmitting and receiving means such that said alarm can be wirelessly remotely activated.

11. The timer apparatus according to claim 2 wherein:

(a) said alarm means produces a mechanical oscillatory signal for sensing by the hearing impaired.

12. A timer apparatus for alerting children to the passage of a selected interval of time, said apparatus comprising:

(a) timing means for counting down the selected interval of time operatively allowing a child wearing said apparatus to directly determine the amount of time remaining to be counted down in the interval of time and to determine when the interval of time has elapsed;

(b) child resistant reset means cooperating with said timing means each time said timer apparatu sis used to allow a user to set the interval of time to be counted down by said timing means and then resist the resetting of the interval of time by a child;

(c) alarm means for signaling the child at the expiration of the interval of time;

(d) a module for receiving said apparatus when not in use and for facilitating the resetting of said timer apparatus; and (e) key means for being adapted to be used to simultaneously trigger said switches; said key means comprise a pair of prongs mounted on said module.

13. A timer apparatus for alerting children to the passage of a selected interval of time, said apparatus comprising:

(a) timing means for counting down the selected interval of time operatively allowing a child wearing said apparatus to directly determine the amount of time remaining to be counted down in the interval of time and to determine when the interval of time has elapsed;

(b) child resistant reset means cooperating with said timing means each time said timer apparatus is used to allow a user to set the interval of time to be counted down by said timing means and then resist the resetting of the interval of time by a child;

(c) alarm means for signaling the child at the expiration of the interval of time;

(d) fastening means securing said timing means to a child; and (e) generally child-resistant latching means for preventing the child from readily removing said timing means from the child once said fastening means is secured; said latching means being operated by key means utilized to reset the inteval of time.

* * * * *